United States Patent [19]

Usui

[11] 4,436,063

[45] Mar. 13, 1984

[54] PUSH ROD FOR OPERATING AN INTAKE OR EXHAUST VALVE OF AN INTERNAL COMBUSTION ENGINE

[75] Inventor: Masayoshi Usui, Numazu, Japan

[73] Assignee: Usui Kokusai Sangyo Kabushiki Kaisha, Shizouka, Japan

[21] Appl. No.: 232,163

[22] Filed: Feb. 6, 1981

[30] Foreign Application Priority Data

Dec. 24, 1979 [JP] Japan ..... 54-178951

[51] Int. Cl.[3] ..... F01L 1/14

[52] U.S. Cl. ..... 123/90.61; 29/156.7 B

[58] Field of Search ..... 123/90.35, 90.61, 90.62, 123/90.63, 90.64; 29/156.7 R, 156.7 B; 74/579 R, 579 E, 581

[56] References Cited

U.S. PATENT DOCUMENTS

| | | | |
|---|---|---|---|
| 1,556,506 | 10/1925 | Fox | 123/90.61 |
| 1,724,836 | 8/1929 | Heinrich | 123/90.61 |
| 1,977,778 | 10/1934 | Rice | 123/90.61 |
| 3,094,107 | 6/1963 | Gondek | 123/90.61 |
| 3,195,527 | 7/1965 | Eaton | 123/90.61 |
| 4,186,696 | 2/1980 | Linsenmann | 123/90.61 |

FOREIGN PATENT DOCUMENTS 55-146211 11/1980 Japan ..... 29/156.7 B

*Primary Examiner*—Craig R. Feinberg
*Assistant Examiner*—W. R. Wolfe
*Attorney, Agent, or Firm*—Anthony J. Casaella; Gerald E. Hespos

[57] ABSTRACT

A valve operating push rod for an internal combustion engine comprises a metal tube having end members with outer hardened surfaces of arcuate shape welded to the respective ends of the tube. A tubular metal member having a length slightly shorter than that of the tube is pressure fitted inside or outside the wall of the tube. At least one of the ends of the tubular member is spaced apart from the welded portion between the tube and the corresponding end member. The problem of vibration between the valve head and valve seat of the intake or exhaust valve of the engine can be minimized in this way due to the different individual vibrations of the tube and tubular member, since at least one end of the tubular member is not in contact with the corresponding welded portion.

9 Claims, 3 Drawing Figures

PUSH ROD FOR OPERATING AN INTAKE OR EXHAUST VALVE OF AN INTERNAL COMBUSTION ENGINE

This invention relates to improvements in and relating to a push rod for operating an intake or exhaust valve of an internal combustion engine.

To enable the prior art to be described with the aid of drawings, the figures of the accompanying drawings will first be described.

Figure 1:
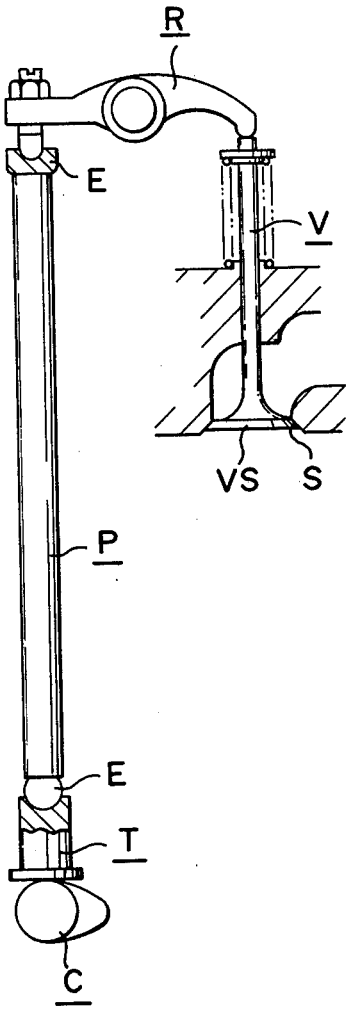
PRIOR ART FIG. 1
FIG. 1 is a view showing use of a prior-art push rod for operating an intake or exhaust valve in an internal combustion engine.

A valve operating push rod P for internal combustion engines is usually used in the manner shown in FIG. 1, serving to transmit rotation of a drive cam C upon rotation of the engine through a tappet T to a rocker arm R, thus operating an intake or exhaust valve V for opening and closing a valve head VS with respect to a co-operating valve seat S.

This type of prior-art push rod consists of a metal tube having end members E with outer hardened surfaces of arcuate profile and secured to the ends of the tube by welding. It is the practice to reduce the thickness of the wall of the tube as much as possible in order to reduce the weight of the product. Therefore, the push rod P tends to flex during operation, and it is likely to experience some vibration due to its flexing and also vibrations of the engine. Such vibrations are transmitted to the intake or exhaust valve where they cause the so-called "vibration" of the valve head VS on the valve seat S, which has adverse effects on the engine.

According to the invention, there is provided a valve operating push rod for an internal combustion engine comprising a metal tube with end members having portions secured to respective ends of said tube, and a tubular metal member pressure fitted to extend along the wall of said tube, said tubular member having a length shorter than that of said tube so that at least one end of said tubular member is spaced apart from the corresponding securing portion between said tube and the corresponding end member.

The above and other features of embodiments of the present invention will become more fully apparent from a detailed consideration of the arrangement and construction in the following description with reference to FIGS. 2 and 3 of the accompanying drawings.

DETAILED DESCRIPTION OF THE PREFERRED EMBODIMENTS

Figure 2:
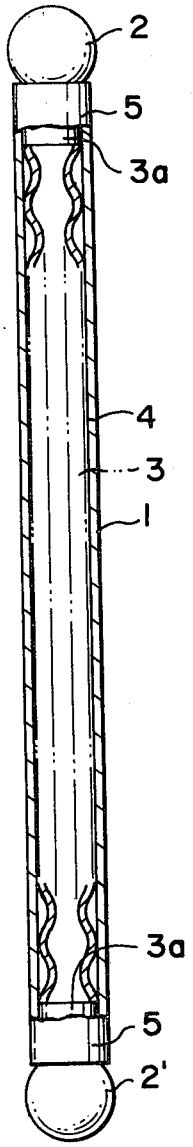
FIG. 2 is a side view, partly broken away, showing an embodiment of a valve operating push rod according to the present invention.

FIG. 2 shows a partly broken-away side view of an embodiment of push rod according to the invention. Designated at 1 is a metal tube having spherical or dish-like end members 2 and 2' each with an outer hardened surface of arcuate profile and secured to the tube ends by electric resistance welding or other suitable means. A tubular metal member 3 having a length dimension slightly shorter than that of the metal tube 1 is pressure fitted within the metal tube 1 such that one end of the member 3 is secured to the corresponding welded portion between the tube 1 and the end member 2 or 2' while the other end of the member 3 is spaced apart from the corresponding welded portion, or that (as shown in FIG. 2) both ends 3*a* of the member 3 are spaced apart from the respective welded portions 5. FIG. 3 shows another embodiment, in which a tubular metal member 3 is pressure fitted outside the metal tube 1, but again with a shorter length dimension.

With these constructions, slight vibrations of the push rod produced during operation of the engine can be largely attenuated or absorbed as a result of friction between the metal tube 1 and tubular metal member 3, since these undergo different individual vibrations. The tubular member 3 may have a wavy longitudinal cross-section as shown in FIG. 2 or be truly cylindrical, as in the embodiment of FIG. 3. In either case the same effects can be obtained.

Figure 3:
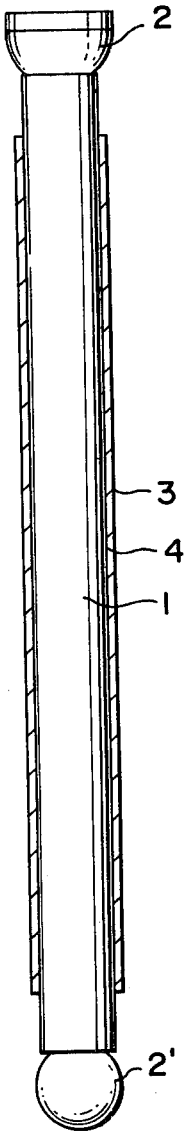
FIG. 3 is a side view, partly broken away, showing another embodiment of the invention.

In FIG. 2, both end members 2 and 2' are spherical; in FIG. 3 the end member 2 is dish-shaped.

While the present invention has been described with reference to particular embodiments thereof, it will be understood that numerous modifications may be made by those skilled in the art without actually departing from the spirit and scope of the invention as defined in the appended claims.

I claim:

1. A valve operating push rod for an internal combustion engine comprising: an elongated metal tube having a pair of opposed ends and a length defined by the distance between the opposed ends of said tube; a pair of end members having portions secured to the ends of said tube respectively; and an elongated tubular metal member having a pair of opposed ends and a length defined by the distance between said opposed ends of said tubular member, said length of said tubular member being substantially the same as the length of said tube, said tubular member being pressure fitted substantially along the entire length of said tube with the opposed ends of said tube being substantially adjacent respectively to the opposed ends of said tubular member, but with at least one end of said tubular member being spaced slightly inwardly from the substantially adjacent end of said tube and the end member secured thereto, whereby operation of the engine generates vibrations which are attenuated by the tube and the tubular member and the pressure fit therebetween.

2. A valve according to claim 1, wherein said tubular member is fitted inside said tube.

3. A push rod according to claim 1, wherein said tubular member is fitted outside said tube.

4. A push rod according to claim 1 wherein both ends of said tubular member are spaced inwardly from the corresponding securing portions between said tube and the respective end members.

5. A push rod according to claim 1, 2 or 3, wherein said end members each have a hardened surface of arcuate profile.

6. A push rod according to claim 1, 2 or 3, wherein said tubular member is cylindrical.

7. A valve according to claim 1, 2 or 3, wherein said tubular member has a wavy longitudinal cross-section.

8. A valve according to claim 1, 2 or 3, wherein said end members are spherical.

9. A push rod according to claim 1, 2 or 3, wherein said end members are dish-shaped.

* * * * *